US005290021A

United States Patent [19]

Murooka et al.

[11] Patent Number: 5,290,021

[45] Date of Patent: Mar. 1, 1994

[54] SHEET FEEDING APPARATUS

[75] Inventors: Ken Murooka; Noriyoshi Ishikawa, both of Yokohama, Japan

[73] Assignee: Canon Kabushiki Kaisha, Tokyo, Japan

[21] Appl. No.: 53,337

[22] Filed: Apr. 28, 1993

Related U.S. Application Data

[63] Continuation of Ser. No. 913,479, Jul. 14, 1992, abandoned.

[30] Foreign Application Priority Data

Jul. 15, 1991 [JP] Japan ..... 3-173950

[51] Int. Cl.[5] ..... B65H 3/06

[52] U.S. Cl. ..... 271/9; 271/111; 355/316; 355/317

[58] Field of Search ..... 271/9, 110, 111, 227; 355/308, 316, 317

[56] References Cited

U.S. PATENT DOCUMENTS 4,786,920 11/1988 Igarashi ..... 271/9 X 5,171,006 12/1992 Naito ..... 271/9

*Primary Examiner*—Richard A. Schacher

*Attorney, Agent, or Firm*—Fitzpatrick, Cella, Harper & Scinto

[57] ABSTRACT

The present invention provides a sheet feeding apparatus comprising automatic sheet supply means for automatically supplying a sheet in an automatic mode, manual sheet insertion means for supplying a manually inserted sheet in a manual mode, first detection means capable of detecting the sheet supplied by the automatic sheet supply means and the sheet supplied by the manual sheet insertion means, second detection means disposed at a downstream side of the first detection means and capable of detecting the sheet, and control means for controlling the supply of the sheet to effect the switching between the automatic mode and the manual mode on the basis of the detection by the first detection means and to effect the pre-feed of the sheet on the basis of the detection by the second detection means.

30 Claims, 9 Drawing Sheets

SHEET FEEDING APPARATUS

This application is a continuation of U.S. patent application Ser. No. 07/913,479 filed Jul. 14, 1992, now abandoned.

BACKGROUND OF THE INVENTION

1. Field of the Invention

The present invention relates to a sheet feeding apparatus used with an image forming system such as a copying machine, laser beam printer and the like.

2. Related Background Art

In the past, as shown in FIG. 21, there has been proposed an image forming system wherein sheets can be automatically supplied from a sheet supply cassette 6 and also can be supplied manually from a manual sheet supply tray 22. In such a conventional image forming system, when the sheet P is supplied automatically, the sheet fed from the sheet supply cassette 6 by a sheet supply roller 10 is fed along a guide G1 by means of a feed roller 11 to reach a photosensitive drum 15 through a space between a lower guide G2 and an upper guide G3.

On the other hand, when the sheet is supplied by the manual sheet insertion, the sheet P set on the manual sheet supply tray 22 is fed to the photosensitive drum 15 through the space between the lower and upper guides G2, G3. Incidentally, the reference numerals 13*a*, 13*b*, 13*c* denote sub-rollers which cooperate with the feed roller to pinch the sheet therebetween for feeding the sheet.

A sensor 20 is disposed at a junction between an automatic sheet feeding path and a manual sheet feeding path. In case of the automatic sheet supply, the sensor 20 serves to register or synchronize the sheet supplied from the sheet supply cassette 6 and a copy timing of the photosensitive drum 15. In case of the manual sheet insertion, the sensor 20 serves to switch an automatic sheet supply mode to a manual sheet insertion mode when the sensor detects the manually inserted sheet P, and to synchronize the manually inserted sheet P with the copy timing of the photosensitive drum 15.

In the above-mentioned conventional image forming system, both in the case of the automatic sheet supply and in the case of the manual sheet insertion, when the sheet P is detected by the sensor 20, the feed roller 11 is stopped to interrupt the feeding of the sheet temporarily. Thereafter, when the copy timing is established, the feed roller is rotated again to send the sheet to the photosensitive drum 15. For example, in a laser beam printer, a data signal sent from a host computer is changed to an image formation signal by a signal processing means, and a laser scanner unit emits a laser beam on the basis of the image formation signal to form an electrostatic latent image on a photosensitive drum. The electrostatic latent image is developed as a toner image, which is then transferred onto a sheet. Now, the sheet P supplied from the sheet supply cassette 6 and the manually inserted sheet P from the manual sheet supply tray 22 is stopped temporality when they are detected by the sensor 20, and are waiting at the stopped position, until the data signal is changed to the signal formation signal by the image processing means. Thus, when a distance between the waiting position and a transfer position was long, it took a long time to feed the sheet from the waiting position to the transfer position, thereby extending the print time. Particularly, in a copying machine or a printer, it has been desired to shorten to the image formation time. Therefore, it is important to reduce the sheet feeding time.

SUMMARY OF THE INVENTION

The present invention aims to eliminate the above-mentioned conventional drawback, and an object of the present invention is to provide a sheet feeding apparatus having an automatic sheet supply mode and a manual sheet insertion mode, which can reduce a sheet feeding time with a simple construction.

The present invention provides a sheet feeding apparatus having a sheet feeding path for an automatic sheet supply and a sheet feeding path for a manual sheet insertion and wherein a first sensor is provided near a junction between the plural sheet feeding paths and a second sensor is disposed at a downstream side of the first sensor, and a control means is provided to switch or change modes between an automatic sheet supply mode and a manual sheet insertion mode when a sheet is detected by the first sensor and to effect the pre-feed when the sheet is detected by the second sensor.

With this arrangement, since the automatic sheet supply mode and the manual shet insertion mode are switched by the first sensor, and the sheet is pre-fed in the proximity of an image forming means such as a photosensitive drum until the sheet is detected by the second sensor, it is possible to reduce the sheet feeding time.

Further, the present invention provides a sheet feeding apparatus wherein a sensor capable of detecting a sheet at a first position and at a second position downstream of the first position is provided near a junction between a sheet feeding path for an automatic sheet supply and a sheet feeding path for a manual sheet insertion, and a control means is provided to switch or change modes between an automatic sheet supply mode and a manual sheet insertion mode when a sheet is detected by the sensor at the first position and to effect the pre-feed when the sheet is detected by the sensor at the second position.

With this arrangement, the same technical advantage as the above can be obtained only by a single sensor.

DETAILED DESCRIPTION OF THE PREFERRED EMBODIMENTS

The present invention will now be explained with reference to the accompanying drawings.

First of all, a first embodiment of the present invention will be described in connection with FIGS. 1 to 10.

Figure 1:
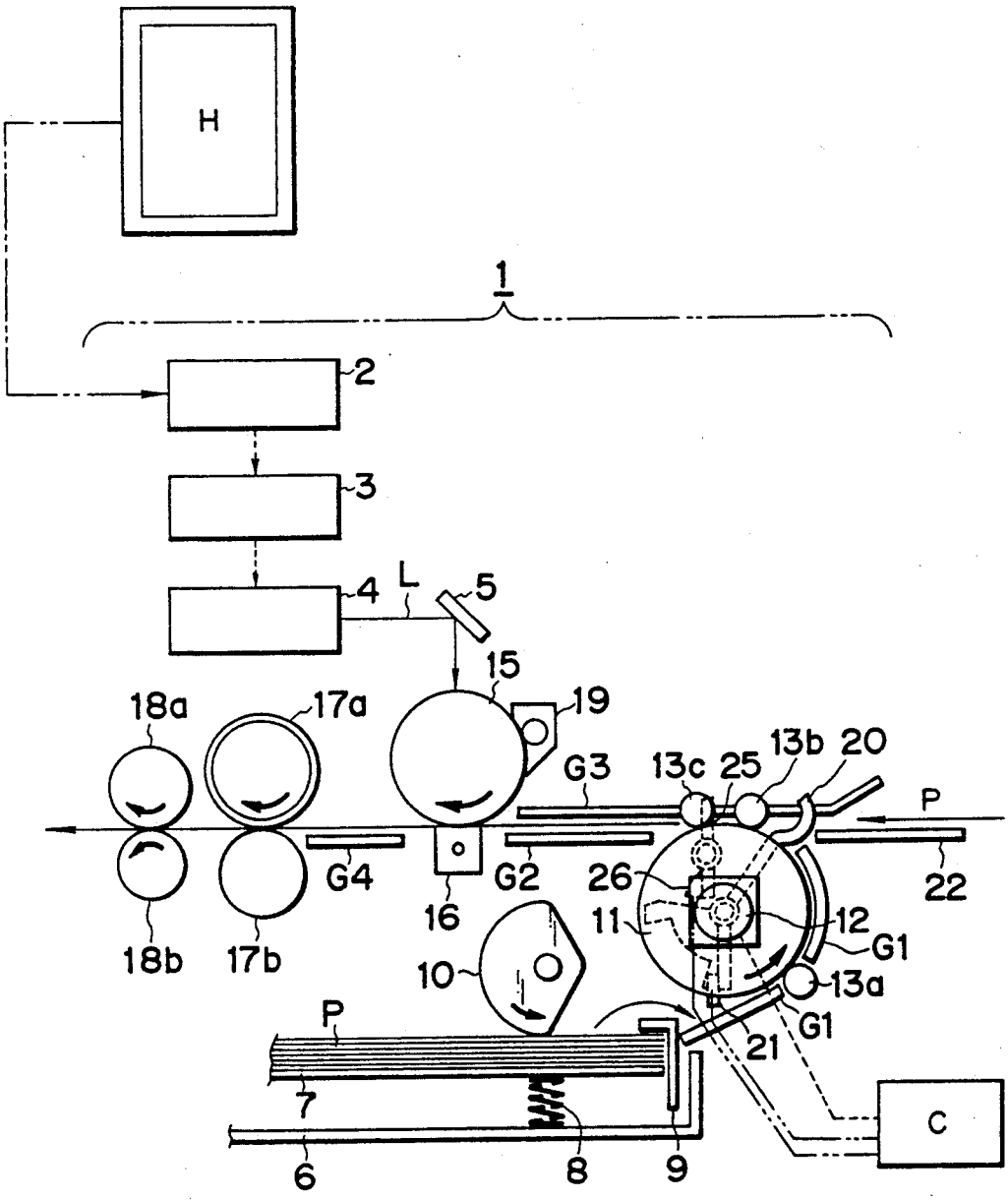
FIG. 1 is an elevational sectional view showing a main construction of an image forming system according to a preferred embodiment of the present invention.
Figure 2:
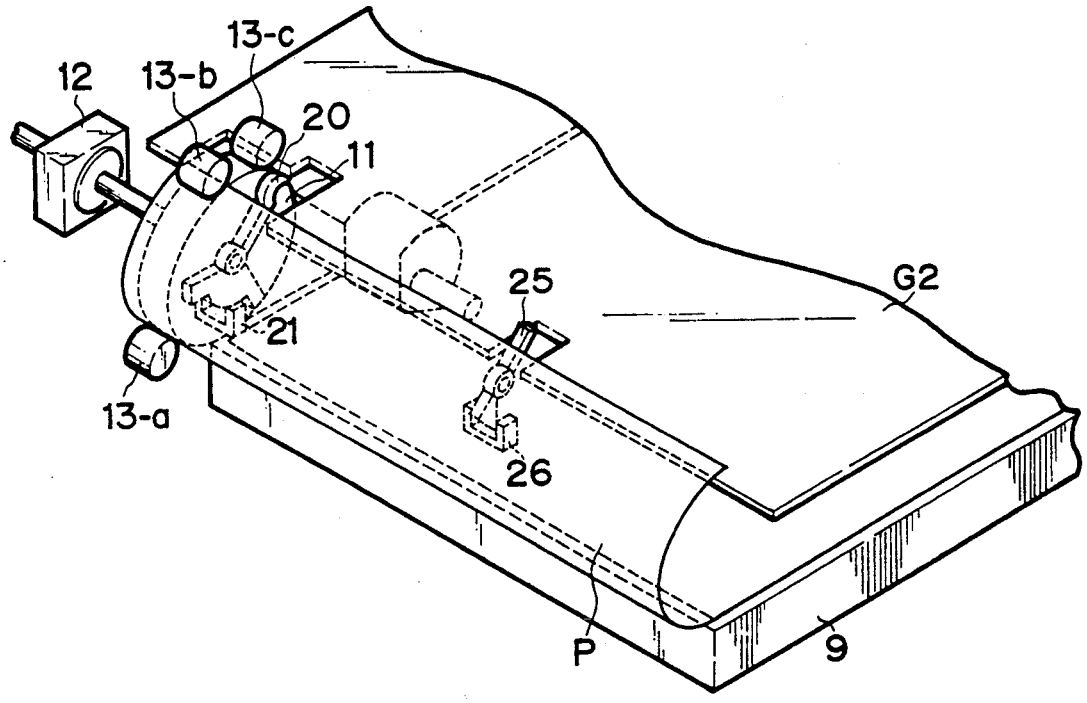
FIG. 2 is a perspective view showing a main portion of the sheet feeding apparatus at an upstream side of a photosensitive drum of FIG. 1.
Figure 3:
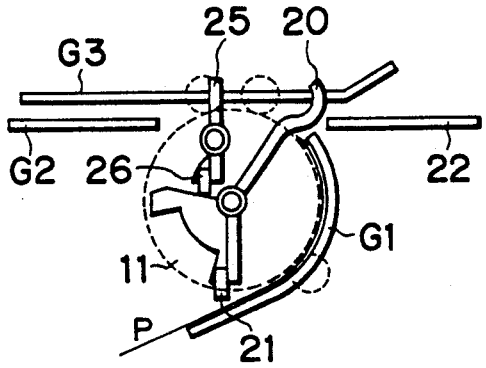
FIGS. 3 to 6 are respectively sectional views showing conditions of a sensor in an automatic sheet supply mode wherein a sheet is supplied from a cassette.
Figure 4:
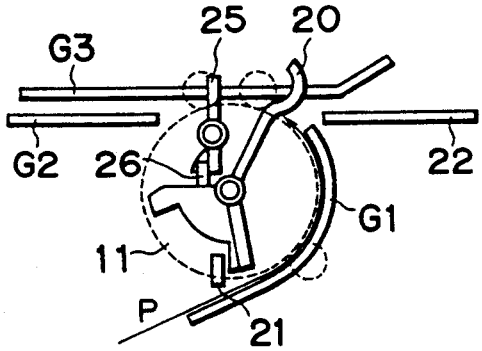
Figure 5:
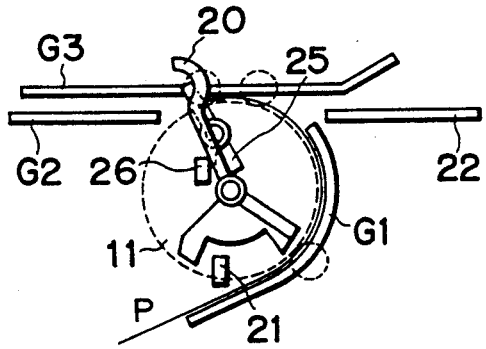
Figure 6:
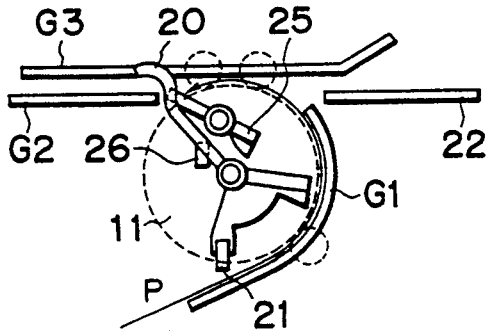

In FIGS. 1 and 2, within a main body 1 of an image forming system, there are arranged a signal processing device 2 for changing a data signal sent from an external host computer H into an image signal, a controller 3 for controlling a laser beam L (described later) on the basis of the image signal from the signal processing device 2, a laser scanner unit 4 for emitting the laser beam L, and a photosensitive drum 15 rotated in a direction shown by the arrow.

The data sent from the host computer H is converted into the image signal by the signal processing device 2, and the laser beam L is outputted from the laser scanner 4 while being controlled by the controller 3 on the basis of the image signal. The laser beam L is reflected by a mirror 5 onto the photosensitive drum 15, thereby forming an electrostatic latent image on the photosensitive drum 15. The electrostatic latent image is developed as a toner image by a developing device 19. Then, the toner image is transferred onto a sheet P by a transfer charger 16.

At a downstream side of the photosensitive drum 15, there are arranged a pair fixing rollers 17*a*, 7*b* for fixing the toner image, and a pair of ejector rollers 18*a*, 18*b* for ejecting the sheet P (after fixing) out of the image forming system. On the other hand, at an upstream side of the photosensitive drum 15, there is arranged a sheet supply cassette 6 including an intermediate plate 7, a compression spring 8 for urging the intermediate plate 7 upwardly and a separating claw 9. A sheet supply roller 10 disposed above the sheet supply cassette 6 serves to feed out the sheets on the intermediate plate 7. Further, in the proximity of and at a downstream side of the intermediate plate 7, there is arranged a feed roller 11 a rotation of which is controlled by a clutch 12. The sheet P supplied by the sheet supply roller 10 is pinched between the feed roller 11 and sub-rollers 13*a*, 13*b*, 13*c* and is fed up to the photosensitive drum 15 in an inverted condition. Incidentally, reference numerals G1, G2, G3 denote guides.

Further, independently from the sheet supply from the cassette 6, a manual sheet supply tray 22 is provided in the same plane as the lower guide G2 in order to permit a manual sheet insertion one by one. When a sheet P is inserted between the manual sheet supply tray 22 and the upper guide G3, the sheet P is pinched between the feed roller 11 and the sub-rollers 13*a*, 13*b*, 13*c* and is fed up to the photosensitive drum 15.

In a sheet feeding path through which the sheet P is fed to the photosensitive drum 15, there are disposed a sensor arm 20 and a photo-sensor 21 which serve to detect a writing (printing) position timing upon the recording on the sheet P, and to switch sheet supply modes from an automatic sheet supply mode to a manual sheet insertion mode. Further, there are also disposed a pre-feed sensor arm 25 and a pre-feed photo-sensor 26 which serve to detect a stop position of the sheet in a recording preparation condition (waiting condition). Signals from these sensors 21 and 26 are inputted to a control means C which in turn controls the clutch 12 connected to the feed roller 11 on the basis of these signals to feed the sheet P properly.

Now, the function of the sensors 21 and 26 will be described.

Figure 7:
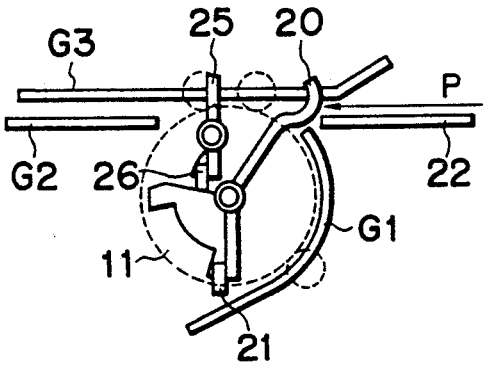
FIGS. 7 to 10 are respectively sectional views showing conditions of a sensor in a manual sheet insertion mode.
Figure 8:
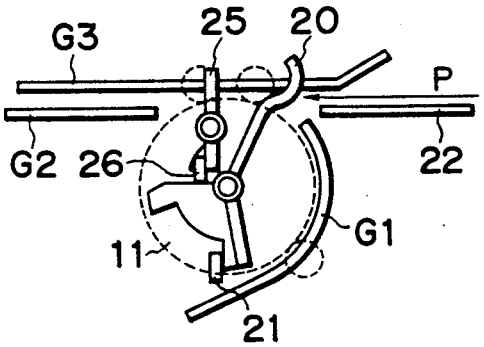

When the sheet P is inserted into a manual sheet insertion opening while being guided by the manual sheet supply tray 22, the sensor arm 20 is rotated in an anti-clockwise direction from a position shown in FIG. 7 to a position shown in FIG. 8. When this movement of the sensor arm is detected by the photo-sensor 21, the automatic sheet supply mode is switched to the manual sheet insertion mode and at the same time the feed roller 11 is rotated, thereby starting the feeding of the sheet P. The switching from the automatic sheet supply mode is switched to the manual sheet insertion mode is effected when it is judged that the mode is the manual sheet insertion mode by detecting the manually inserted sheet P by means of the photo-sensor 21 in a condition that a command signal for the automatic sheet supply mode is not inputted. When the sheet P reaches a position shown by the arrowhead in FIG. 9, a detection signal is emitted from the pre-feed sensor arm 25 and the pre-feed sensor 26, with the result that the clutch 12 temporarily interrupts the transmission of a driving force to the feed roller 11. In this way, the sheet P is waiting until the image signal is obtained. Hereinafter, the phase that the sheet P is temporarily stopped at while awaiting the image signal is referred to as "pre-feed". By effecting the pre-feed, the sheet no longer has to wait in the cassette 6 but rather in the proximity of the photosensitive drum 15 thereby making it possible to reduce the time duration for the sheet reach up to the photosensitive drum 15 after the image signal is obtained.

After the pre-feed, when the development of the image signal is finished, the transmission of the driving force to the feed roller 11 is started again. When the sensor arm 20 reaches a position shown in FIG. 10, an auxiliary scan synchronous signal is detected by the photo-sensor 21, thus outputting the laser beam L at the proper timing. As mentioned above, the toner image formed on the photosensitive drum 15 is transferred onto the sheet P by the transfer charger 16, and, as mentioned above, after the transferred image is fixed to the sheet P, the latter is ejected out of the image forming system by the paired ejector rollers 18*a*, 8*b* (shown in FIG. 1).

Further, when the command signal for the automatic sheet supply mode is inputted to feed the sheet P from the sheet supply cassette 6, the sheet is fed out by the sheet supply roller 10 and at the same time the feed roller 11 is rotated. Thereafter, similar to, the manual sheet insertion, the pre-feed is effected to the position shown by the arrowhead in FIG. 5 and the auxiliary scan synchronous signal is detected at the position of the sensor arm 20 shown in FIG. 6. Thereafter, the toner image is transferred onto the sheet and then is fixed to the sheet by the paired fixing rollers 17*a*, 17*b* (shown in FIG. 1). Then, the sheet is ejected. Incidentally, in the case where the sheet is supplied from the cassette 6, no control is performed at the conditions of the photosensor 21 shown in FIGS. 3 and 4.

Next, a second embodiment of the present invention will be described with reference to FIGS. 11 to 20. Incidentally, the same elements as those in the first embodiment are designated by the same reference numerals and the detailed explanation thereof will be omitted.

In a sheet feeding path through which the sheet P is fed to the photosensitive drum 15, there is disposed a sensor arm 20 which serves to detect the auxiliary scan synchronous signal upon the recording on the sheet P, to detect a leading end of the inserted sheet P to switch sheet supply modes from an automatic sheet supply mode to a manual sheet insertion mode, and to detect a stop position for the recording preparation condition of the sheet P. The sensor arm 20 has a shield surface for blocking a photo-sensor 21 and a cutout portion through which the light can pass.

Figure 13:
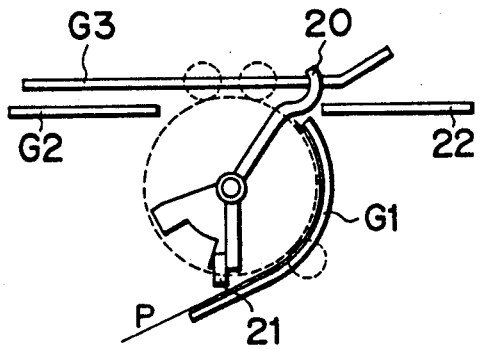
FIGS. 13 to 16 are respectively sectional views showing conditions of a sensor in an automatic sheet supply mode wherein a sheet is supplied from a cassette, according to the second embodiment.
Figure 14:
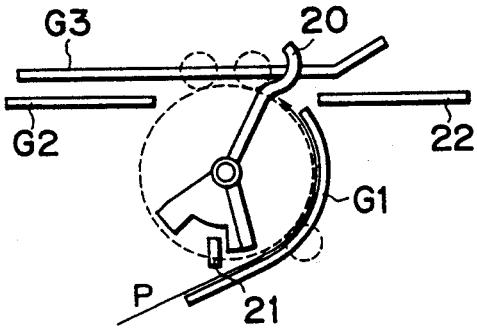
Figure 15:
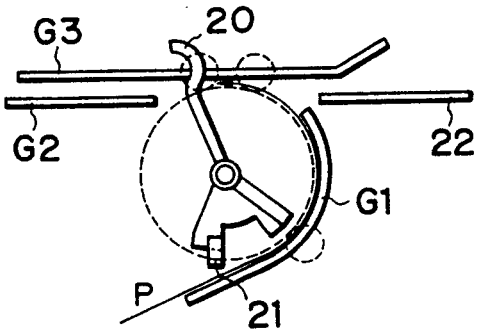

When the sheet P is supplied from the sheet supply cassette 6, the sensor arm 20 is rotated in an anti-clockwise direction from a position shown in FIG. 13. When the sheet P is sent up to a position shown in FIG. 14, the cutout portion in the shield surface of the sensor arm 20 passes through the photo-sensor 21. When the sheet P is fed to a position shown in FIG. 15, the shield surface of the sensor arm 20 blocks the photo-sensor 21 again. By a signal detected at this position, the clutch 12 is activated to stop the transmission of the driving force to the feed roller 11. In this way, the sheet P remains at this position until the image signal is obtained. When the development of the image signal is finished, the clutch 12 starts the transmission of the driving force to the feed roller 11 again, thus restarting the feeding of the sheet P.

Figure 16:
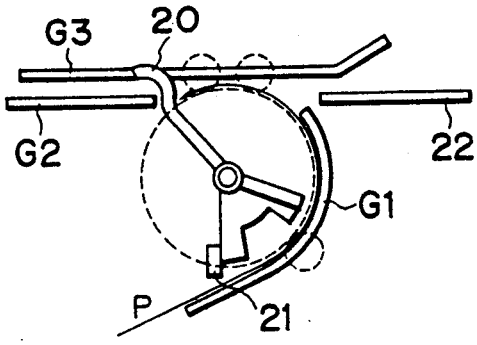
Figure 17:
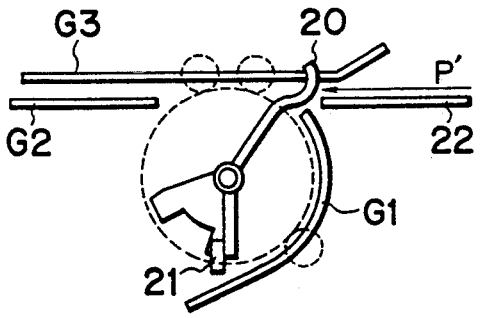
FIGS. 17 to 20 are respectively sectional views showing conditions of a sensor in a manual sheet insertion mode, according to the second embodiment.
Figure 18:
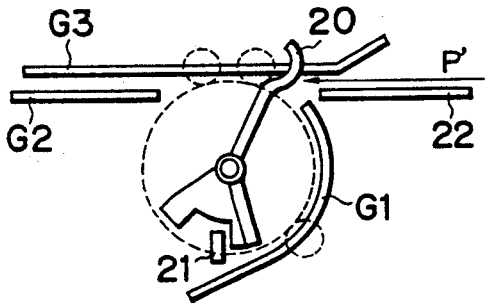

When the sheet P is sent to a position shown in FIG. 16, a writing start position for the image is detected. On the basis of the timing so obtained, the laser beam L is emitted at the proper timing. After the sheet P passes through the sub-roller 13*c*, since there is no roller between the sub-roller 13*c* and the photosensitive drum 15, the sheet can be stably fed to the photosensitive drum 15 without any shock such as impact against any roller.

On the other hand, in case of the manual sheet insertion, the sheet P is inserted between the manual sheet supply tray 22 and the upper guide G3. When the sheet is inserted, the sensor arm 20 is rotated in an anti-clockwise direction from a position shown in FIG. 17. When the sensor arm reaches a position shown in FIG. 18, the cutout of the shield surface of the sensor arm 20 reaches the photo-sensor 21, thus detecting the fact that the sheet P is supplied from the manual sheet supply tray 22. At this point, the automatic sheet supply mode is switched to the manual sheet insertion mode and at the same time the feed roller 11 is rotated, whereby the sheet P is pinched between the feed roller 11 and the rollers 13*b*, 13*c* and fed by these rollers. When the sheet P reaches a position shown in FIG. 19, similar to the case where the sheet is supplied from the sheet supply cassette 6, the sheet is temporarily stopped at this position, thereby providing the pre-feed condition. In this condition, since the leading end of the sheet P has passed the sub-roller 13*b* and the leading end portion of the sheet is pinched between the feed roller 11 and the sub-roller 13*b*, even when an operator removes his hand from the sheet, the sheet does not drop from the image forming system. When the development of the image signal is finished, the driving force is transmitted to the feed roller 11, thus restarting the feeding of the sheet P. Similar to the case where the sheet is supplied from the cassette, the auxiliary scan synchronous signal is detected at a position shown in FIG. 20, thereby emitting the laser beam L at the proper timing.

Then, as mentioned above, the sheet P is sent to the photosensitive drum 15 through the space between the guides G2 and G3. As shown in FIG. 1, after the toner image formed on the photosensitive drum 15 is transferred onto the sheet P by the transfer charger 16, the sheet is fed along the feed guide G4 to reach the paired fixing rollers 17*a*, 17*b*, where the toner image is fixed to the sheet as mentioned above. Then, the sheet is ejected by the paired ejector rollers 18*a*, 18*b* out of the image forming system.

As mentioned above, according to the illustrated embodiments, the following advantages can be obtained.

Figure 9:
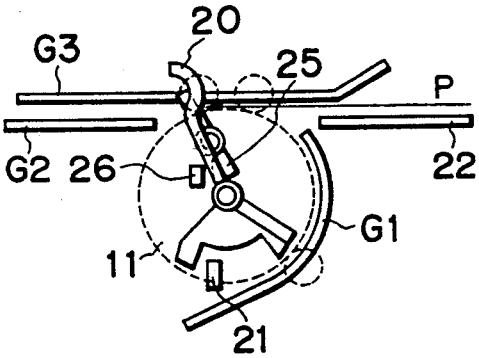
Figure 10:
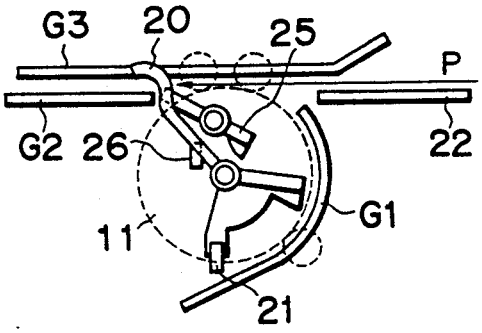
Figure 11:
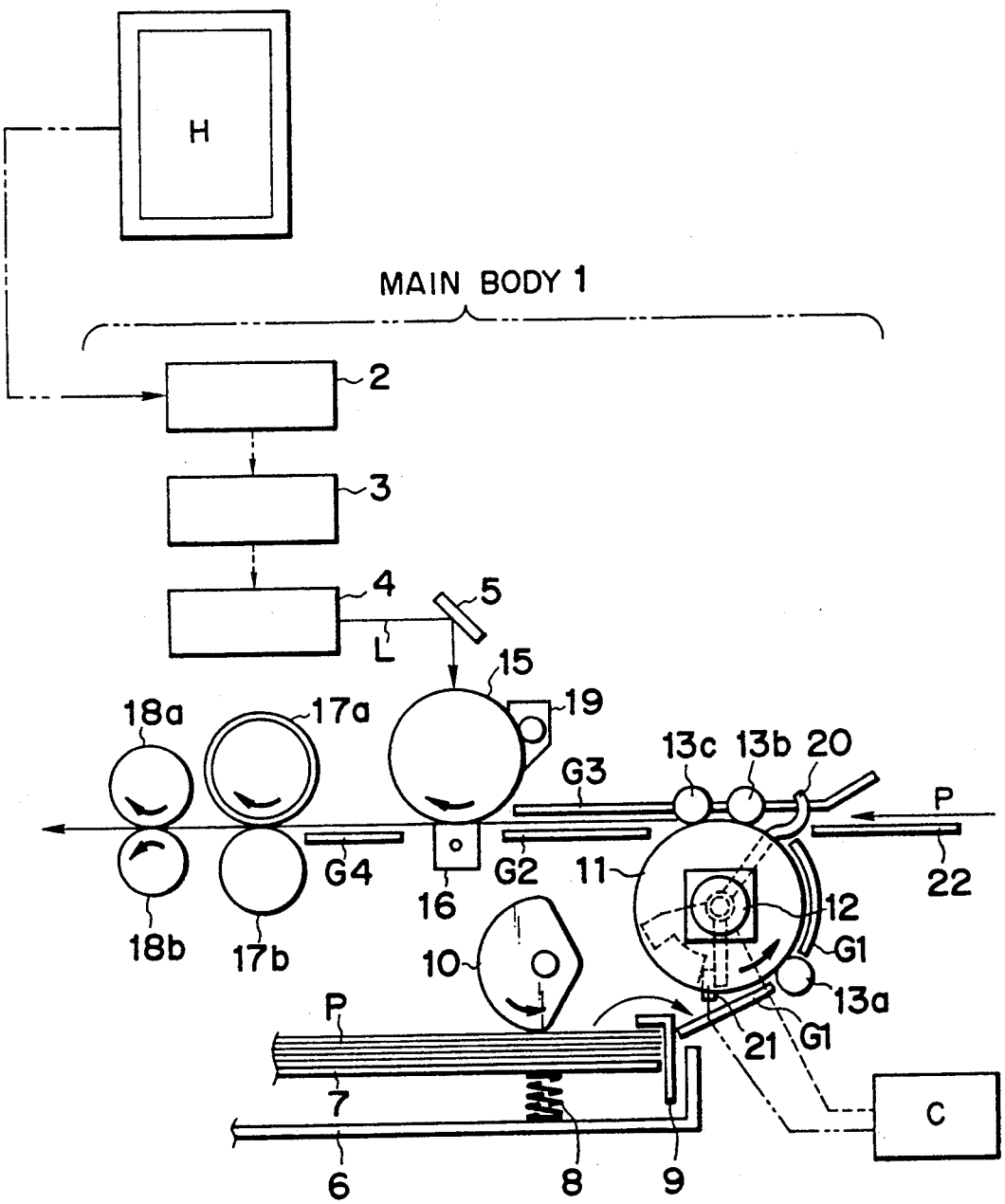
FIG. 11 is an elevational sectional view showing a main construction of an image forming system according to a second embodiment of the present invention.
Figure 12:
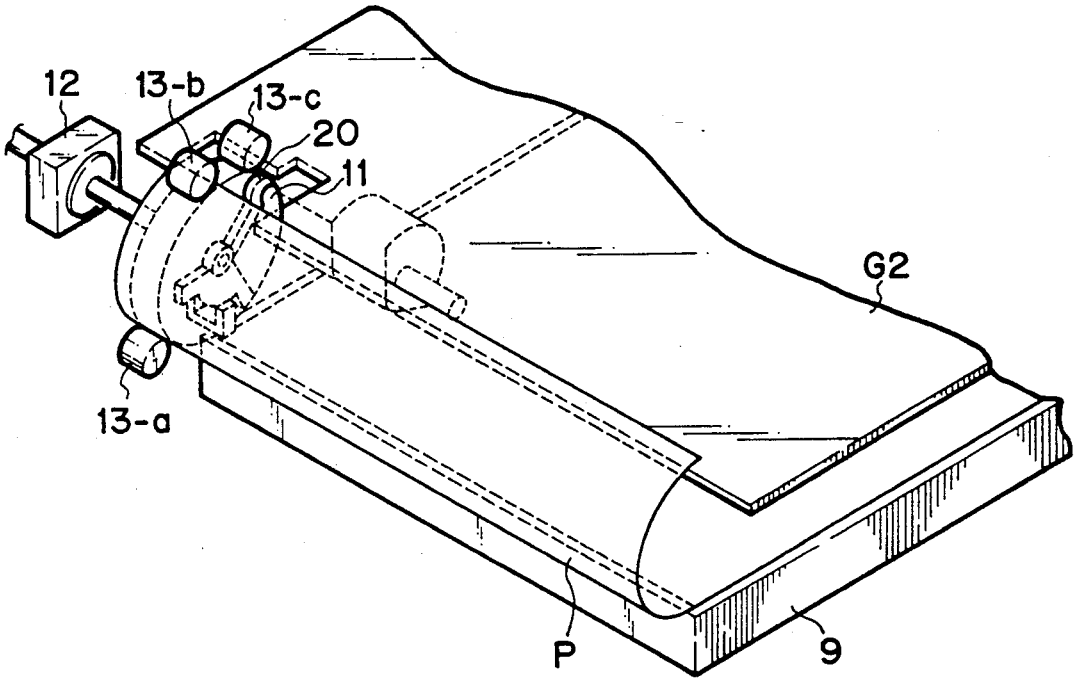
FIG. 12 is a perspective view showing a main portion of the sheet feeding apparatus at an upstream side of a photosensitive drum of FIG. 11.
Figure 19:
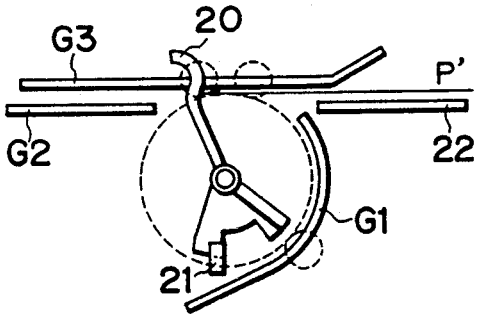
Figure 20:
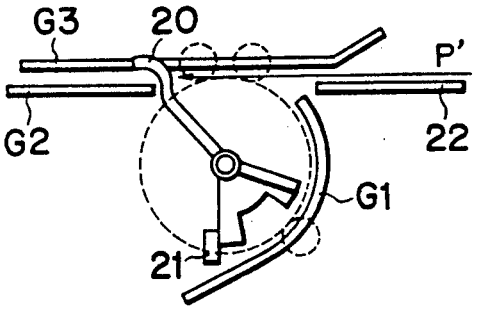
Figure 21:
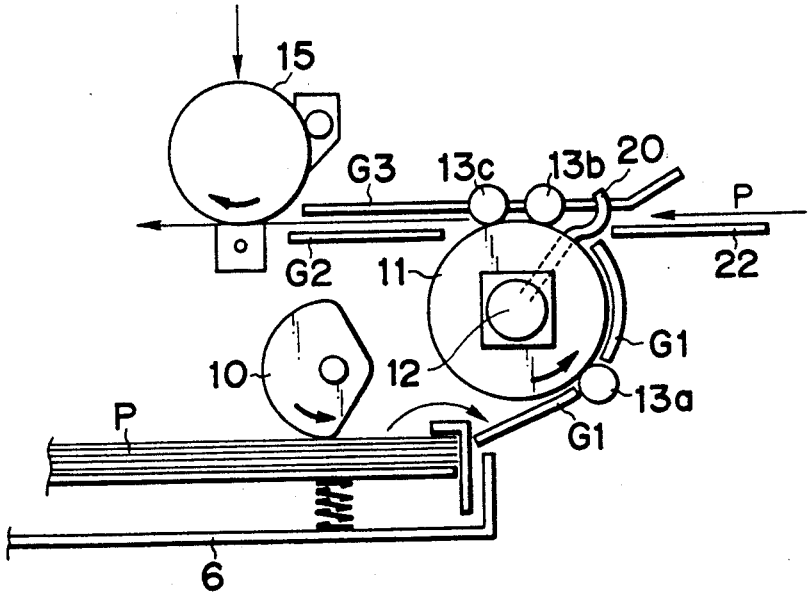
FIG. 21 PRIOR ART
FIG. 21 is an elevational sectional view of a conventional image forming system.

(1) By stopping the sensor arm 20 at the position shown in FIGS. 9 and 19, it is possible to effect the pre-feed while pinching the leading end portion of the sheet P between the feed roller 11 and the sub-roller 13*b* in the manual sheet insertion mode, so that when the operator removes his hand from the sheet, the sheet does not drop from the image forming system.

(2) Since the auxiliary scan synchronous signal is detected at the position beyond the last sub-roller (13*c*) at the upstream side of the photosensitive drum 15, it is possible to avoid the erroneous operation due to the shock such as the impact of the sheet against any roller, thus preventing the bad influence upon the image recording quality.

(3) In the second embodiment, since the detection means (single sensor) serves to detect the leading end of the sheet inserted into the image forming system through the manual sheet insertion inlet, thereby switching the sheet supply mode from the automatic sheet supply mode to the manual sheet insertion mode, and to detect the stop position for stopping the sheet in the predetermined recording preparation condition, and to emit the auxiliary scan,. synchronous signal, it is possible to reduce the size of the sheet feeding apparatus and to reduce the manufacturing cost.

As mentioned above, according to the present invention, since the pre-feed can be realized in the image forming system having both the automatic sheet supply mode and the manual sheet insertion mode, it is possible to provide an image forming system which can reduce sheet feeding time and achieve high speed image formation.

What is claimed is:

1. A sheet feeding apparatus, comprising:

automatic sheet supply means for automatically supplying a sheet in an automatic mode;

manual sheet insertion means for supplying a manually inserted sheet in a manual mode;

first detection means capable of detecting the sheet supplied by said automatic sheet supply means and the sheet supplied by said manual sheet insertion means;

second detection means disposed at a downstream side of said first detection means and capable of detecting the sheet; and control means for controlling the supply of the sheet to effect the switching between said automatic mode and said manual mode on a basis of the detection by said first detection means and to effect the pre-feed of the sheet on the basis of the detection by said second detection means.

2. A sheet feeding apparatus according to claim 1, wherein said control means switches said automatic mode to said manual mode when the sheet is detected by said first detection means in a condition that a command signal for said automatic mode is not inputted.

3. A sheet feeding apparatus according to claim 2, wherein said automatic sheet supply means comprises supporting means for supporting a plurality of sheets, supplying means for feeding out the sheet supported by said supporting means, feed guide means for guiding the sheet fed out by said supplying means, and feed means for feeding the sheet along said feed guide means.

4. A sheet feeding apparatus according to claim 3, wherein said manual sheet insertion means comprises a manual tray for supporting the sheet, feed guide means for guiding the sheet inserted to said manual tray, and feed means for feeding the sheet along said feed guide means.

5. A sheet feeding apparatus according to claim 4, wherein said control means causes said feed means to feed the sheet fed out by said automatic supplying means until the sheet is detected by said second detection means and causes the sheet to wait in a pre-feed condition by stopping the feeding of the sheet when the sheet is detected by said second detection means, in said automatic mode; and wherein said control means causes said feed means to start the feeding to the inserted sheet when this sheet is detected by said first detection means and causes the sheet to wait in the pre-feed condition by stopping the feeding of the sheet when the sheet is detected by said second detection means, in said manual mode.

6. A sheet feeding apparatus according to claim 4, wherein said feed guide means of said automatic sheet supply means and said feed guide means of said manual sheet insertion means are joined together as a junction at downstream ends of said supply means.

7. A sheet feeding apparatus according to claim 6, wherein said first detection means is disposed in the proximity of said junction at a downstream side thereof, and said second detection means is spaced apart from said first detection means by a predetermined distance in a direction downstream of said first detection means.

8. A sheet feeding apparatus according to claim 7, wherein single feed means is arranged in correspondence to said junction, whereby said single feed means serves both as said feed means of said automatic sheet supply means and as said feed means of said manual sheet insertion means.

9. A sheet feeding apparatus according to claim 8, wherein said single feed means comprises a feed roller.

10. A sheet feeding apparatus according to claim 9, wherein said feed guide means of said automatic sheet supply means guides the sheet fed out by said supplying means while inverting the sheet, and said feed roller forms a part of an inverting portion of said feed guide means.

11. A sheet feeding apparatus according to claim 9, wherein said first detection means comprises an arm projecting in said feed guide means to be moved by the fed sheet, and a sensor for detecting the movement of said arm to emit a signal.

12. A sheet feeding apparatus according to claim 11, wherein said second detection means comprises an arm projecting in said feed guide means to be moved by the fed sheet, and a sensor for detecting the movement of said arm to emit a signal.

13. A sheet feeding apparatus according to claim 12, wherein said arms of said first and second detection means are pivotally supported for pivotal movement around an axis of a driving shaft of said feed roller.

14. A sheet feeding apparatus, comprising:

automatic sheet supply means for automatically supplying a sheet in an automatic mode;

manual sheet insertion means for supplying a manually inserted sheet in a manual mode;

single detection means capable of detecting the sheet supplied by said automatic sheet supply means and the sheet supplied by said manual sheet insertion means at a first detection position in a sheet supplying path and at a second detection position disposed downstream of said first detection position; and control means for controlling the supply of the sheet to effect the switching between said automatic mode and said manual mode on the basis of the detection of the sheet at said first detection position and to effect a pre-feed of the sheet on the basis of the detection of the sheet at said second detection position.

15. A sheet feeding apparatus according to claim 14, wherein said control means switches said automatic mode to said manual mode when the sheet is detected by said detection means at said first detection position in a condition that a command signal for said automatic mode is not inputted.

16. A sheet feeding apparatus according to claim 15, wherein said automatic sheet supply means comprises supporting means for supporting a plurality of sheets, supplying means for feeding out the sheet supported by said supporting means, feed guide means for guiding the sheet fed out by said supplying means, and feed means for feeding the sheet along said feed guide means.

17. A sheet feeding apparatus according to claim 16, wherein said manual sheet insertion means comprises a manual tray for supporting the sheet, feed guide means for guiding the sheet inserted to said manual tray, and feed means for feeding the sheet along said feed guide means.

18. A sheet feeding apparatus according to claim 17, wherein said control mean causes said feed means to feed the sheet fed out by said automatic supplying means until the sheet is detected by said detection means at said second detection position and causes the sheet to wait in a pre-feed condition by stopping the feeding of the sheet when the sheet is detected by said second detection position, in said automatic mode; and wherein said control means causes said feed means to start the feeding of the inserted sheet when this sheet is detected by said detection means at said first detection position and causes the sheet to wait in the pre-feed condition by stopping the feeding of the sheet when the sheet is detected by said second detection position, in said manual mode.

19. A sheet feeding apparatus according to claim 17, wherein said feed guide means of said automatic sheet supply means and said feed guide means of said manual sheet insertion means are joined together as a junction at downstream ends of said supply means.

20. A sheet feeding apparatus according to claim 19, wherein said detection means comprises an arm projecting in said feed guide means to be moved by the fed sheet, and a sensor for detecting the movement of said arm to emit a signal, and said arm has a cutout portion causing said sensor to emit a detection signal.

21. An image forming system, comprising:

automatic sheet supply means for automatically supplying a sheet in an automatic mode;

manual sheet insertion means for supplying a manually inserted sheet in a manual mode;

first detection means capable of detecting the sheet supplied by said automatic sheet supply means and the sheet supplied by said manual sheet insertion means;

second detection means disposed at a downstream side of said first detection means and capable of detecting the sheet;

control means for controlling the supply of the sheet to effect the switching between said automatic mode and said manual mode on the basis of the detection by said first detection means and to effect the pre-feed of the sheet on the basis of the detection by said second detection means; and image forming means for forming an image on the pre-fed sheet.

22. An image forming system, comprising:

automatic sheet supply means for automatically supplying a sheet in an automatic mode;

manual sheet insertion means for supplying a manually inserted sheet in a manual mode;

single detection means capable of detecting the sheet supplied by said automatic sheet supply means and the sheet supplied by said manual sheet insertion means at a first detection position in a sheet supplying path and at a second detection position disposed at a downstream side of said first detection position;

control means for controlling the supply of the sheet to effect the switching between said automatic mode and said manual mode on the basis of the detection of the sheet at said first detection position and to effect a pre-feed of the sheet on the basis of the detection of the sheet at said second detection position; and image forming means for forming an image on the pre-fed sheet.

23. A sheet feeding apparatus comprising:

automatic sheet supply means for automatically supplying a sheet in an automatic mode;

manual sheet insertion means for supplying a manually inserted sheet in a manual mode;

a common path for guiding the sheet supplied by said automatic sheet supply means and the sheet supplied by said manual sheet insertion means;

detection means for detecting at least three positions of the sheet guided in said common path and outputting a detection signal; and control means for controlling said automatic sheet supply means and manual sheet insertion means such that the automatic and manual modes are switched in accordance with the detection of the sheet at a first position, the sheet is pre-fed in accordance with the detection of the sheet at a second position and the sheet is in synchronism in operation with an image forming section and in accordance with the detection of the sheet at a third position.

24. A sheet feeding apparatus according to claim 23, wherein said detection means has first and second sensors, and said first sensor detects said first position to input said detection signal and said second sensor detects said second and third positions to input said detection signal.

25. A sheet feeding apparatus according to claim 23, wherein said detection means has a sensor which comprises a swingable sensor arm having two light-shielding surfaces and a photosensor for inputting said detection signal when light is shielded by said light-shielding surfaces.

26. A sheet feeding apparatus according to claim 23, wherein said control means switches said automatic mode to said manual mode when the sheet is detected by said detection means at said first position in a condition that a command signal for said automatic mode is not inputted.

27. A sheet feeding apparatus according to claim 26, wherein said automatic sheet supply means comprises supporting means for supporting a plurality of sheets, supplying means for feeding out the sheet supported by said supporting means, feed guide means for guiding the sheet fed out by said supplying means, and feed means for feeding the sheet along said feed guide means.

28. A sheet feeding apparatus according to claim 26, wherein said manual sheet insertion means comprises a manual tray for supporting the sheet, feed guide means for guiding the sheet inserted to said manual tray, and feed means for feeding the sheet along said feed guide means.

29. A sheet feeding apparatus according to claim 28, wherein said control means causes said feed means to feed the sheet fed out by said automatic sheet supplying means until the sheet is detected at said second position by said detection means and causes the sheet to wait in a pre-feed condition by stopping feeding of the sheet when the sheet is detected at said second position by said detection means in said automatic mode, and wherein said control means causes said feed means to start feeding of the inserted sheet when the sheet is detected at said first position by said detection means and cause the sheet to wait in the pre-feed condition by stopping feeding of the sheet when the sheet is detected at said second position by said detection means.

30. An image forming system comprising:

automatic sheet supplying means for automatically supplying a sheet in an automatic mode;

manual sheet insertion means for supplying a manually inserted sheet in a manual mode;

a common path for guiding the sheet supplied by said automatic sheet supply means and the sheet supplied by said manual sheet insertion means;

detection means for detecting at least three positions of the sheet guided in said common path and outputting a detection signal;

control means for controlling said automatic sheet supply means and manual sheet insertion means in such that the automatic and manual modes are switched in accordance with the detection of the sheet of a first position, the sheet is pre-fed in accordance with the detection of the sheet at a second position and the sheet is in synchronism in operation with an image forming section and in accordance with the detection of the sheet at a third position; and image forming means for forming an image on the pre-fed sheet.

* * * * *

UNITED STATES PATENT AND TRADEMARK OFFICE

CERTIFICATE OF CORRECTION

PATENT NO. : 5,290,021

DATED : March 1, 1994

INVENTOR(S) : KEN MUROOKA, ET AL.

It is certified that error appears in the above-indentified patent and that said Letters Patent is hereby corrected as shown below:

Column 1,
Line 61, "is" should read --are--, and "temporality" should read "temporarily--.

Column 2,
Line 24, "shet" should read --sheet--.

Column 3,
Line 34, "pair fixing rollers 17a, 7b" should read --pair of fixing rollers 17a, 17b--.

Column 4,
Line 17, "is" should be deleted;
Line 18, "switched" should be deleted;
Line 19, "judged" should read --determined--;
Line 30, "at" should be deleted;
Line 35, "reach" should read --to reach--; and
Line 48, "8b" should read --18b--.

UNITED STATES PATENT AND TRADEMARK OFFICE

CERTIFICATE OF CORRECTION

PATENT NO. : 5,290,021

DATED : March 1, 1994

INVENTOR(S) : KEN MUROOKA, ET AL.

It is certified that error appears in the above-indentified patent and that said Letters Patent is hereby corrected as shown below:

Column 5,
Line 7, "end" should read --edge--;
Line 57, "end" should read --edge--; and
Line 58, "end" should read --edge--.

Column 6,
Line 16, "end" should read --edge--;
Line 22, "the position" should read --a position--; and
Line 29, "end" should read --edge--.

Column 7,
Line 24, "to" (second occurrence) should read --of--.

Signed and Sealed this

Twenty-third Day of August, 1994

Bruce Lehman

*Attest:*

BRUCE LEHMAN

*Attesting Officer*

*Commissioner of Patents and Trademarks*